United States Patent [19]

Washburn

[11] Patent Number: 4,681,038

[45] Date of Patent: Jul. 21, 1987

[54] AMMUNITION CARTRIDGE CASE

[75] Inventor: William J. Washburn, San Clemente, Calif.

[73] Assignee: Aerojet-General Corporation, La Jolla, Calif.

[21] Appl. No.: 825,122

[22] Filed: Feb. 3, 1986

[51] Int. Cl.[4] ..... F42B 5/26

[52] U.S. Cl. ..... 102/464; 102/430; 102/434

[58] Field of Search ..... 102/434, 464–468, 102/430, 432, 433

[56] References Cited

U.S. PATENT DOCUMENTS

| | | | |
|---|---|---|---|
| 3,435,765 | 4/1969 | Gawlick | 102/466 X |
| 3,882,778 | 5/1975 | Gawlick et al. | 102/466 |
| 4,024,819 | 5/1977 | Schirneker | 102/430 |
| 4,197,801 | 4/1980 | La Fever | 102/433 |

*Primary Examiner*—Harold J. Tudor
*Attorney, Agent, or Firm*—Leonard Tachner

[57] ABSTRACT

An ammunition round cartridge case having a stress riser in the form of at least one elongated recess adapted for preserving the seal of ignition gases within the cartridge case during initial stages of ignition and also adapted for allowing a splitting of the cartridge case wall surface at peak gas pressure within the cartridge case during firing whereby to permit easy extraction or push-through ejection of the cartridge case from the gun chamber subsequent to firing of the round. A preferred embodiment utilizes a unitary recess that is parallel to the longitudinal axis of the cartridge case, longer than one-half of the length of the cartridge case and which has a triangular cross-section the apex of which extends more than halfway into the wall surface of the cartridge case.

10 Claims, 4 Drawing Figures

AMMUNITION CARTRIDGE CASE

BACKGROUND OF THE INVENTION

1. Field of the Invention

The present invention relates generally to high performance ammunition and more particularly, to a cartridge case with the capability of splitting during firing to make the case easy to extract or eject in a push-through system. Such a cartridge case is especially useful and advantageous in telescoped ammunition systems.

2. Prior Art

Ammunition systems which employ push-through techniques to dispose of a spent cartridge case after a round has been fired, must overcome the inherent problems of case expansion or obturation due to the extreme gas pressures produced during firing. Such case expansion can permanently deform a cartridge case due to residual hoop strain in the cartridge case wall until it becomes jammed in the gun chamber and disables the gun until the cartridge case can be forcefully removed, usually only with great difficulty.

Any solution to this problem must still seal the cartridge case prior to firing and preferably during the initial stages of ignition to permit sufficient increase in gas pressures to propel the projectile with desired acceleration, muzzle velocity and other ballistic parameters. Furthermore, the cartridge cast must provide load support for the ammunition round during transport and handling and it must protect the solid propellant material within the cartridge case to guard against propellant fracture or the entry of moisture or other contaminants which might otherwise detrimentally affect ballistic performance of the round.

One prior art attempt at solving this problem has been the rolled cartridge case wherein the cartridge case wall comprises numerous overlapping layers of a thin walled rolled structure. Unfortunately, such a structure creates end-seal retention problems that would otherwise complicate the case configuration. Furthermore, the rolled case configuration does not solve the premature gas leakage or load support problems previously mentioned. Furthermore, a rolled configuration can present other difficulties associated with a discontinuity along the interior of the cartridge case wall.

There is therefore a long-felt need for an improved cartridge case which overcomes the aforementioned difficulties and this need has not been satisfied by the prior art.

SUMMARY OF THE INVENTION

The present invention satisfies the aforementioned long-felt need by providing an improved cartridge case having a stress riser in the form of at least one elongated recess in the case wall and which is adapted for preserving the seal of the ignited gases within the cartridge case during the initial stages of ignition. This recess is also adapted to permit a split of the case wall surface at peak gas pressure within the cartridge case during firing of the ammunition round whereby to facilitate easy push-through ejection of the cartridge case from the chamber or extraction from a non-tapered chamber subsequent to firing the round.

A preferred embodiment utilizes a unitary elongated recess that is parallel to the longitudinal axis of the cartridge case, that is longer than one-half the length of the cartridge case and which comprises a triangular cross-section the apex of which extends more than halfway into the wall surface of the cartridge case.

This invention finds particularly advantageous use in telescoped ammunition rounds, but is not to be deemed to be limited to such ammunition.

OBJECTS OF THE INVENTION

It is therefore a principal object of the present invention to provide an improved cartridge case which does not incur the residual hoop strain problems of the prior art and which is therefore more suitable for easy ejection using push-through ejection techniques in gun systems.

It is an additional object of the present invention to provide an improved ammunition round cartridge case comprising a hollow circular cylinder formed from a continuous wall surface and having at least one elongated recess in the wall surface, the recess being of selected length, depth, shape and location to cause a split of the wall surface along the recess in response to ignition of the ammunition round.

It is still an additional object of the present invention to provide an improved telescoped ammunition round of the type having a cartridge case which contains a main propellant charge forming a bore for receiving a projectile and also having a booster charge for propelling the projectile through the bore before the main propellant charge is ignited to fire the projectile, the improvement comprising a cartridge case in the form of a cylinder having a continuous wall surface including at least one elongated recess in the wall surface, the recess being parallel to the longitudinal axis of the cartridge case, being longer than at least half of the length of the cartridge case and having a triangular cross-section, the apex of which is located more than halfway into the wall surface whereby to produce a split of the wall surface along the recess in response to firing of the projectile whereby to make it easy to eject the spent cartridge case utilizing push-through ejection techniques or conventional extraction techniques.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings in which.

DETAILED DESCRIPTION OF A PREFERRED EMBODIMENT

Figure 1:
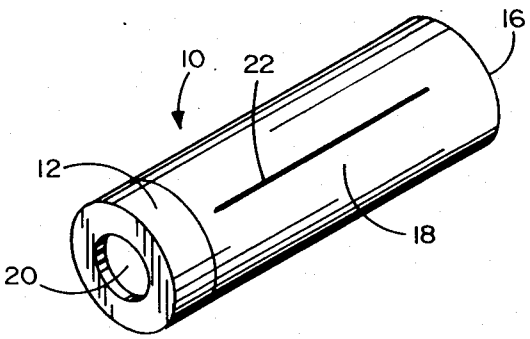
FIG. 1 is an isometric representation of a cartridge case employing the present invention.
Figure 2:
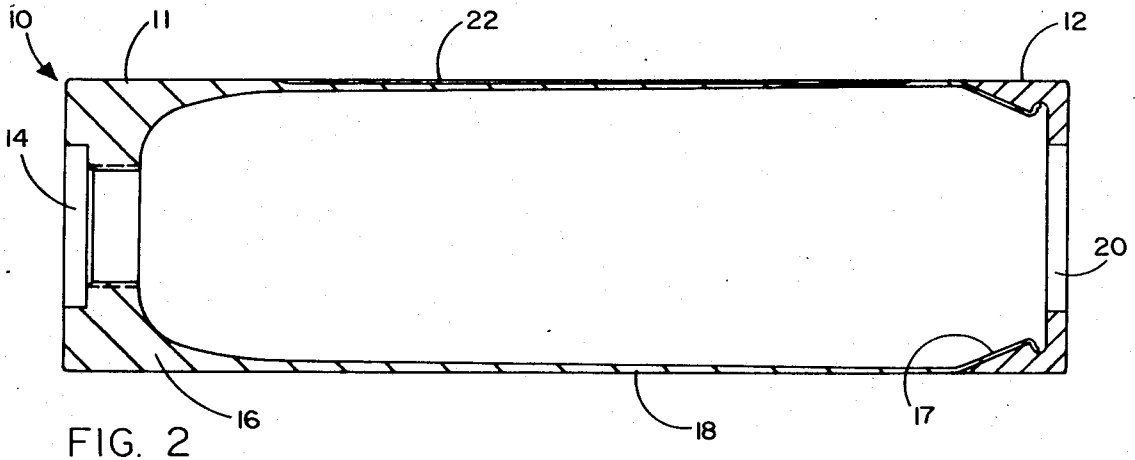
FIG. 2 is a cross-sectional view of the cartridge case of FIG. 1.

Referring first to FIGS. 1 and 2 it will be seen that a particular embodiment of the improved cartridge case 10 of the present invention comprises a substantially hollow, circular cylinder 11 terminating at its forward end 17 in an end cap 12 which provides a projectile exit aperture 20. The cartridge case 10 also provides a booster tube aperture 14 located axially along the aft end 16. Circular cylinder 11 is formed primarily by a wall surface 18 which is adapted to house a solid propellant grain (not shown) which in turn forms a cylindrical bore adapted to receive a projectile as more fully illustrated and explained in copending patent application Ser. No. 825,429 filed Feb. 3, 1986 by the applicant hereof.

Figure 3:
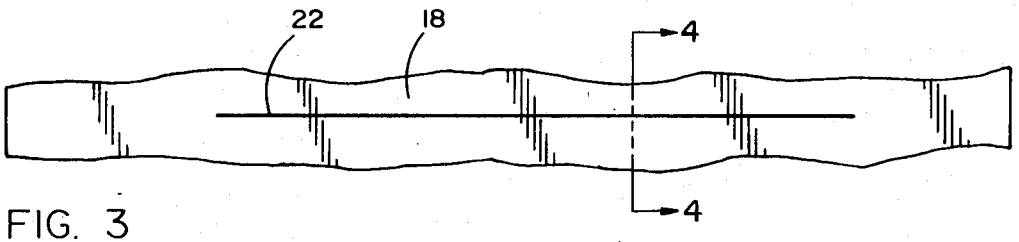
FIG. 3 is an enlarged top view of the portion of the cartridge case of FIGS. 1 and 2 illustrating the inventive recess contained therein.

As seen best in FIGS. 2 and 3, the improved cartridge case of the present invention provides a unitary elongated recess 22 in the wall surface 18. Recess 22 in the particular embodiment illustrated herein extends substantially parallel to the longitudinal axis of the circular cylinder 11 and is of a length which is equal to approximately 64% of the full length of the cartridge case 10 including the end cap 12. It will be understood however that the present invention is not necessarily limited to the use of only one such recess nor is it necessarily limited to elongated recesses which are parallel to the longitudinal axis of the circular cylinder making up the cartridge case 10. The invention may also include cartridge cases of additional recesses some of which may be perpendicular or otherwise non-parallel with respect to the longitudinal axis of the case.

As seen in FIGS. 1, 2 and 3, recess 22 terminates short of the ends of cylinder 11.

Figure 4:
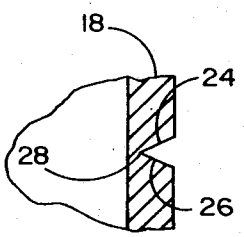
FIG. 4 is a further enlarged sectional view of the recess of the present invention taken along lines 4—4 of FIG. 3.

A preferred cross-section of the elongated recess 22 may be seen best in FIG. 4. More specifically, as seen in FIG. 4, elongated recess 22 has a triangular cross-section comprising a diagonal recess surface 24 and a diagonal recess surface 26. The two surfaces 24 and 26 intersect at an apex 28 at an angle of approximately 60 degrees. It will also be seen in FIG. 4 that the depth of the recess as measured to the apex 28 is more than half the depth of the wall surface 18 and in the particular embodiment illustrated is approximately 75% of the depth of the wall surface. It has been found that by utilizing an elongated recess having a triangular cross-section with an apex that extends more than halfway into the depth of the wall surface of the cartridge case, the objectives of the present invention as hereinbefore delineated can be readily met. More specifically, the recess 22 of the present invention, particularly as shown in detail in FIG. 4, provides a cartridge case which can readily withstand the normal loads of transport and handling that avoids the use of a discontinuity along the inner surface of the cartridge case, which seals the propellant from contamination and also seals the gases generated upon ignition of the main propellant at least during the earlier stages of the ignition process and which permits splitting of the cartridge case wall during peak pressures of the ignition process whereby to preclude any form of jamming of the cartridge case within the gun chamber due to residual hoop strain as previously described.

It will now be understood that what has been disclosed herein comprises a cartridge case of the type containing a propellant charge for propelling a projectile through the bore of a gun barrel upon ignition of the charge in a gun system wherein the cartridge case is pushed through and ejected from the gun barrel after the projectile is fired. The improved cartridge case of the present invention comprises a hollow, circular cylinder formed from a continuous wall surface and having at least one elongated recess in the wall surface, the recess being of selected length, depth, shape and location to cause a split of the wall surface along the recess in response to ignition and firing of the ammunition round of which the cartridge case is a component. In a particular preferred embodiment, the aforementioned elongated recess is substantially parallel to the axis of the cylinder forming the cartridge case, the recess is longer than half the length of the cylinder and the recess has a triangular cross-section, the apex of which is located more than halfway into the exterior wall surface.

The invention provides an improved cartridge case having a stress riser in the form of the aforementioned elongated recess for preserving the seal of the ignition gases within the cartridge case during the initial stages of ignition but also permitting a split of the case wall surface at peak gas pressure within the cartridge case during firing of the ammunition round whereby to facilitate easy push-through, ejection of the cartridge case subsequent to firing the round. Although the invention finds particularly advantageous use in telescoped ammunition rounds, it is not necessarily limited to such forms of ammunition. Splitting of the cartridge case prevents residual hoop strain from otherwise jamming the cartridge case against the walls of the gun barrel thereby preventing push-through ejection or conventional rearward extraction of the cartridge case subsequent to firing the round.

Those having skill in the art to which the present invention pertains will now, as a result of the applicant's teaching herein, perceive various modifications and additions to the invention. By way of example, other recesses or stress risers of different lengths, shapes, depths and locations will now be understood to provide alternative means for accomplishing the objectives of the present invention whereby to initially retain the gas pressure during the early stages of the ignition process and subsequently to permit a split of the cartridge case wall surface in order to preclude jamming of the cartridge case which may otherwise prevent push-through ejection of the cartridge case after the ammunition round has been fired. However, it will be understood that all such modifications and additions are deemed to be within the scope of the present invention which is to be limited only by the claims appended hereto.

I claim:

1. A catridge case for use with telescoped ammunition and of the type containing a propellant charge for propelling a projectile through a bore of a gun barrel upon ignition of the charge in a gun system wherein the cartridge case is pushed through and ejected from the gun chamber after the projectile has been fired, the case comprising:

a hollow circular cylinder formed from a continuous wall surface and having at least one elongated recess in said wall surface, said recess being longer than half the length of said cylinder and terminating short of the ends of said cylinder to cause a split of said wall surface along said recess in response to said ignition.

2. The cartridge case of claim 1 wherein said recess is substantially parallel to the axis of said cylinder.

3. The cartridge case of claim 1 wherein said recess is of a triangular cross-section.

4. The cartridge case of claim 3 wherein the apex of said triangular cross-section is located more than halfway into said wall surface.

5. The cartridge case of claim 1 wherein said recess is substantially parallel to the axis of said cylinder, wherein said recess is of a triangular cross-section having an apex located more than halfway into said wall surface.

6. An improved push-through ejection telescoped ammunition round of the type having a cartridge case containing a main propellant charge forming a bore for receiving a projectile and also containing a booster charge for propelling the projectile through the bore before igniting the main propellant charge to fire the projectile; the improvement comprising a cartridge case in the form of a cylinder formed from a continuous wall surface and having at least one elongated recess in said wall surface, said recess being longer than half the length of said cylinder and terminating short of the ends of said cylinder for yielding to the pressure produced upon igniting said main propellant charge to cause a split of said wall surface along said recess in response to firing said propellant while preserving the seal of ignition gases within said cartridge case during firing.

7. The improvement of claim 6 wherein said recess is substantially parallel to the axis of said cylinder.

8. The improvement of claim 6 wherein said recess is of a triangular cross-section.

9. The improvement of claim 8 wherein the apex of said triangular cross-section is located more than halfway into said wall surface.

10. The improvement of claim 6 wherein said recess is substantially parallel to the axis of said cylinder, wherein said recess is longer than half of the length of said cylinder, and wherein said recess if of a triangular cross-section having an apex located more than halfway into said wall surface.

* * * * *